United States Patent [19]

Suga

[11] 4,006,379

[45] Feb. 1, 1977

[54] CARBON ELECTRODES FOR AN ULTRAVIOLET ARC LAMP FOR USE IN A LIGHT-FASTNESS TESTER

[76] Inventor: Shigeru Suga, Yoyogi 5-20-2, Shibuya, Tokyo, Japan

[22] Filed: Dec. 19, 1975

[21] Appl. No.: 642,359

[52] U.S. Cl. ..... 313/352; 13/18; 314/60; 313/311; 313/354; 313/355

[51] Int. Cl.[2] ..... H01J 1/02; H01J 1/14; H01J 1/38; H01J 1/48

[58] Field of Search ..... 313/352, 353, 354, 355, 313/356, 357, 311; 13/15, 16, 18; 314/51, 52, 60

[56] References Cited

UNITED STATES PATENTS

| | | | |
|---|---|---|---|
| 1,186,253 | 6/1916 | Wilcox | 313/354 |
| 2,185,679 | 1/1940 | Parisot | 313/354 X |
| 2,229,227 | 1/1941 | Simon et al. | 313/354 |
| 2,282,533 | 5/1942 | Simon et al. | 313/354 |
| 3,313,976 | 4/1967 | Lauzau et al. | 313/357 X |
| 3,461,339 | 8/1969 | Robiette | 313/354 X |

*Primary Examiner*—Saxfield Chatmon, Jr.
*Attorney, Agent, or Firm*—Wenderoth, Lind & Ponack

[57] ABSTRACT

Upper and lower carbon electrodes for an ultraviolet arc lamp used for light-fastness testing. The upper electrode is in the shape of an elongated cylinder, the cross-section of which has an exterior annular portion consisting of a carbonaceous material and an interior core portion consisting of a mixture of a carbonaceous material and potassium sulfate. The upper electrode has dispersed therethrough potassium chloride as a stabilizing agent. The lower electrode is in the shape of an elongated cylindrical tube having a hollow interior and is of a carbonaceous material having a high electrical conductivity and has dispersed therethrough potassium chloride as a stabilizing agent. When the upper and lower electrodes are placed with their ends opposed to each other and an alternating current at 135V and 16A is discharged thereacross, a stable light is continuously produced.

2 Claims, 14 Drawing Figures

CARBON ELECTRODES FOR AN ULTRAVIOLET ARC LAMP FOR USE IN A LIGHT-FASTNESS TESTER

This invention relates to an improvement in carbon electrodes for an ultraviolet arc lamp for use in a light-fastness tester.

BACKGROUND OF THE INVENTION AND PRIOR ART

A typical structure of a conventional carbon arc lamp is illustrated in FIG. 1. As shown, two carbon electrodes are secured to a lower electrode holder, and one carbon electrode is secured to an upper electrode holder movable in a vertical direction inside the air-tight lamp housing consisting of a light-transmitting glass glove 1 and a substrate board 2. The upper electrode can be ignited and controlled by an iron core inside an electromagnetic coil 3 and a carbon suspension member 4 associated with said iron core.

Generally, the upper carbon electrode has a length of about 305mm and a diameter of about 13mm, and is either a core type or a coreless type. To make the lower carbon electrodes, a 305mm long carbon electrode, such as is used for the upper carbon electrode, has two lengths of 100mm cut therefrom, and the two thus formed electrodes are used as the lower carbon electrodes. The two electrodes are discharged alternately for a continuous combustion period of from about 20 to 22 hours.

As shown in the sectional views of FIGS. 2 and 3, the conventional carbon electrode has been either a coreless type (FIG. 2) or a core type (FIG. 3). The coreless type electrode is made predominantly of an amorphous carbonaceous material, such as carbon black or the like, whereas the core type electrode uses the above-mentioned amorphous carbonaceous material for the exterior cylindrical section and a mixture of a stabilizing agent, such as potassium phosphate and the amorphous carbonaceous material for the interior core section.

A piece of material to be tested is mounted on a frame which rotates slowly around the arc lamp, and the piece of material is continuously irradiated by ultraviolet rays from the lamp over a period of several hundred hours to determine the light-fastness thereof.

Since the conventional carbon electrode has a life of only about 20–22 hours for continuous lighting, it would be desirable to extend this life to at least twice this time.

It is evident that if the length or the diameter of the carbon electrodes was increased, the combustion time could naturally be extended. An increase in the length of the carbon electrodes, however, is not economical because it also increases the overall dimension of the lamp apparatus. Although an increase in the diameter of the carbon electrodes does not cause any substantial change in the overall dimensions of the apparatus, stabilized light cannot be obtained if the diameter of the conventional carbon electrodes is increased unless the material is also changed. As shown in FIG. 4, for example, carbon electrodes having such an enlarged diameter do not always discharge from the tip thereof, but instead may discharge from the peripheral portion spaced from the tip. Likewise, the wearing of the carbon electrodes is not always uniform.

In the light of the teachings of my copending U.S. patent application Ser. No. 598,076 filed July 22, 1975, one of ordinary skill in the art would perhaps attempt to replace the carbon electrodes of the conventional lamp with upper and lower carbon electrodes which incorporate a mixture of a carbonaceous material and an illuminating agent as the core. When such carbon electrodes are used in practice in an ultraviolet arc lamp, however, discharge is effected from points spaced from the tip of the upper electrode as shown in FIG. 5. Thus, the discharge of this type of arc lamp has been found to be very unstable in practice.

Presumably this unstability results from the fact that because the carbon in said electrodes in said copending application is for use in an arc lamp for producing light similar to sunshine, and the carbon is burned in an atmosphere wherein oxygen is present, the carbon in the electrodes of the present invention is for use in an arc lamp for producing ultraviolet light, and hence, the combustion takes place in the absence or substantially complete absence of oxygen.

OBJECTS AND BRIEF SUMMARY OF THE INVENTION

The primary object of the present invention is to stabilize the discharge of carbon electrodes in a light-fastness tester and increase the combustion time of the electrodes to at least twice the life of conventional electrodes.

Another object of the present invention is to improve the life of the electrodes by adding a particular type of stabilizer and disposing a hollow core section at the central portion of the lower electrode such that evaporation of the stabilizer causes convection resulting in stabilization of the discharge of the electrode.

These objects achieved in accordance with the present invention by impregnating and dispersing a stabilizing agent in both the upper and lower carbon electrodes. The upper carbon electrode having the stabilizer impregnated and dispersed therein has a core section while the lower carbon electrode also having the stabilizer impregnated and dispersed therein has a hollow hole along the longitudinal axis thereof. The upper electrode having the core section and the lower electrode having the hole cause the stabilizer to exhibit its action most effectively and afford a stabilized discharge, and hence stabilized radiation for a longer period of time than with conventional electrodes.

BRIEF DESCRIPTION OF THE FIGURES

The invention will now be described in greater detail in connection with the accompanying drawings, in which.

DETAILED DESCRIPTION OF THE INVENTION

FIGS. 6*a*, 6*b*, 7*a* and 7*b* illustrate the structure of the carbon electrodes in accordance with the present invention.

Figure 6A:
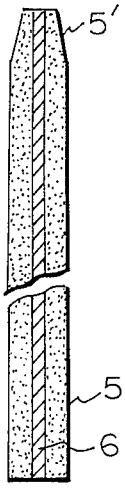
FIG. 6*a* is a longitudinal sectional view of an upper carbon electrode in accordance with the present invention.
Figure 6B:
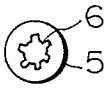
FIG. 6*b* is a transverse sectional view thereof.

FIGS. 6*a* and 6*b* illustrate the upper electrode. The exterior carbonaceous cylindrical portion 5 is made of a carbonaceous material such as, for example, carbon black, and has a predetermined size, e.g. an outer diameter of 23mm, while the interior core portion 6 has a gear-like cross-sectional shape. After the exterior portion 5 of the upper electrode is shaped by baking so as to have a hollow core, a core material consisting of a mixture of the abovementioned carbonaceous material, e.g. carbon black, and potassium sulfate is poured into the hollow core, and the electrode is again baked to form the core portion 6 within the exterior portion 5. Subsequently, a potassium chloride aqueous solution (having a concentration of 10 g/l is impregnated into the electrode to act as a stabilizing agent, and the electrode is then baked once again in order to disperse the stabilizer throughout the electrode. As a result of this process, a typical upper electrode according to the invention has about 61 gm. carbonaceous material and from 0.18 to 0.10 gm of potassium chloride, or about 0.32 to 0.06% by weight potassium chloride.

Figure 7A:
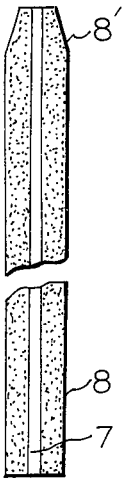
FIG. 7*a* is a longitudinal sectional view of a lower carbon electrode in accordance with the present invention.
Figure 7B:
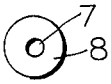
FIG. 7*b* is a transverse sectional view thereof.

FIGS. 7*a* and 7*b* show the lower electrode which is formed by shaping a carbonaceous material having a good electric conductivity, such as graphite, into a cylindrical member 8 and then baking the same. Thereafter, the electrode is immersed in a potassium chloride aqueous solution (having a concentration of 15 g/l ) as a stabilizing agent until the stabilizer disperses sufficiently inside the electrode. As a result of this process, a typical lower electrode according to the invention has about 42 gm carbonaceous material and from 0.13 to 0.07 gm. of potassium chloride, or about 0.32 to 0.06% by weight potassium chloride. The electrode has an outer diameter of about 18.5mm, and a hollow core 7 having a diameter of about 1–2mm. The tips 5' and 8' of the electrodes are tapered in order to facilitate the discharge at the initial stage, but the tip need not always be tapered.

Figure 1:
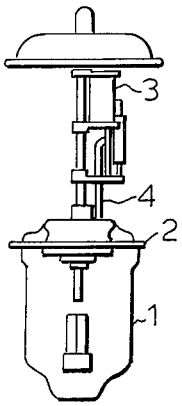
(PRIOR ART) FIG.1
FIG. 1 is a schematic elevation view of a conventional ultraviolet arc lamp for use in a light-fastness tester.
Figure 2:
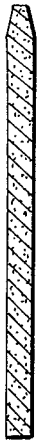
(PRIOR ART) FIG.2
FIGS. 2 and 3 are sectional views of conventional prior art carbon electrodes.
Figure 3:
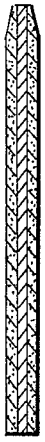
(PRIOR ART) FIG.3
Figure 4:
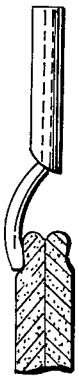
(PRIOR ART) FIG.4
FIG. 4 is a schematic view showing the discharge between conventional prior art carbon electrodes.
Figure 5:
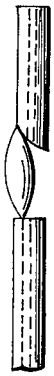
(PRIOR ART) FIG.5
FIG. 5 is a schematic view showing the discharge between prior art carbon electrodes for producing radiation simulating sunshine.

One each of the abovementioned lower and upper electrodes are mounted in the lamp device shown in FIG. 1. Since the diameter of the carbon electrodes and the number of electrodes used in the present invention are different from the conventional device, the holder section is modified in the present invention to accept the abovementioned upper and lower electrodes.

Figure 8:
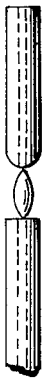
FIGS. 8 and 9 are schematic views showing the discharge between the carbon electrodes of the present invention.
Figure 9:
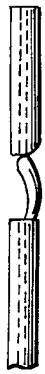

FIGS. 8 and 9 illustrate the discharge produced with the electrodes of the present device. In FIG. 8, the discharge is shown as being produced between the core section of the upper electrode and the hollow core of the lower electrode to thereby produce a stabilized illumination which varies hardly at all. As the electrodes are consumed gradually, the upper electrode still keeps discharging from the core section, while the discharge from the lower electrode shifts from the center to the periphery, as shown in FIG. 9, smoothly and producing a stabilized discharge in the same manner as when the discharge is at the center. Thereafter, the discharge from the lower electrode moves back to the central position from the periphery. This procedure is repeated continuously.

Figure 10:
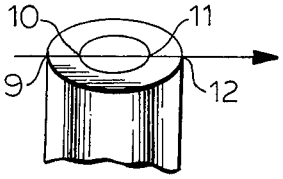
FIG. 10 is a schematic perspective view showing the end of the lower electrode of the present invention.

As shown in FIG. 10, the lower electrode has exterior peripheral portions 9 and 12 and interior peripheral portions 10 and 11 aligned in the transverse direction thereof (indicated by the arrow). In comparison with the conventional solid lower electrode having only two peripheral portions, the lower electrode in accordance with the present invention has four peripheral portions, as described above. For this reason, wearing of the electrode at only one peripheral portion or abnormal wearing can be eliminated effectively by the present electrode.

Figure 11:
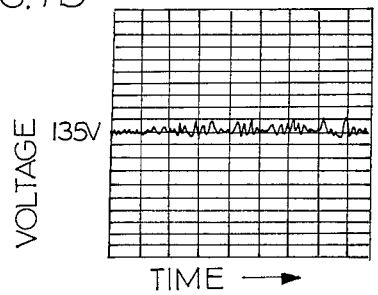
FIG. 11 is a graph showing discharge voltages of the carbon electrodes of the present invention.
Figure 12:
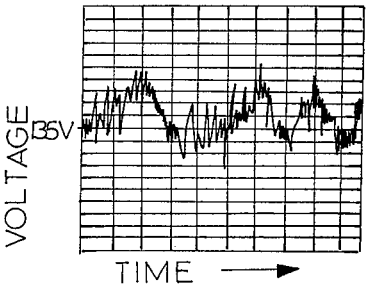
FIG. 12 is a graph showing discharge voltages of conventional carbon electrodes.

The operation of the electrodes in accordance with the present invention was compared with conventional electrodes by effecting discharge at a predetermined current of 16A, and the changes in the discharge voltage were measured. The results of the experiments are shown in FIGS. 11 and 12. FIG. 11 shows the voltage change observed with the present electrodes. As can be seen, the electrodes of this invention produce a fluctuation in voltage of only about 1% at a reference voltage of 135V. In contrast therewith, the conventional electrodes produce a fluctuation of several percent.

The reason the discharge in the present device is extremely stable is not fully understood. However, the inventor believes that the stability can perhaps be explained by the fact that the stabilizer impregnated into and dispersed in the electrode evaporates and changes to a gas at a high temperature, and creates an atmosphere of the gas thus formed, in which the discharge is effected. Likewise, the flow of the stabilizer gas passing through the hollow core of the lower electrode acts favorably for the discharge.

Thus, with electrodes in accordance with the present invention, a well stabilized discharge illumination can be produced continuously over a period of 50 hours by the use of carbon electrodes which in terms of size have only an enlarged outer diameter compared with the outer diameter of conventional carbon electrodes in general.

What is claimed is:

1. Carbon electrodes for an ultraviolet arc lamp used for light-fastness testing, said electrodes comprising:

an upper electrode in the shape of an elongated cylinder about 23 mm. in diameter, the cross-section of which has an exterior annular portion consisting of a carbonaceous material and an interior core portion consisting of a mixture of a carbonaceous material and potassium sulfate, the upper electrode having dispersed therethrough potassium chloride as a stabilizing agent; and a lower electrode in the shape of an elongated cylindrical tube about 18.5 mm. in diameter and having a hollow interior about 1–2 mm. in diameter and being of a carbonaceous material having a high electrical conductivity and having dispersed therethrough potassium chloride as a stabilizing agent;

whereby when the upper and lower electrodes are placed with their ends opposed to each other and an alternating current at 135V and 16A is discharged thereacross, the discharge can be maintained stably for more than 50 hours and a stable light is continuously produced.

2. Carbon electrodes as claimed in claim 1 in which potassium chloride is present in an amount of from 0.32 to 0.06% by weight of the carbonaceous material.

* * * * *